US005634271A

United States Patent [19]

Lipper

[11] Patent Number: 5,634,271

[45] Date of Patent: Jun. 3, 1997

[54] METHOD OF FORMING AN AUTOMOTIVE WHEEL

[75] Inventor: Raymond W. Lipper, Newport Beach, Calif.

[73] Assignee: Center Line Tool Co., Inc., Santa Fe Springs, Calif.

[21] Appl. No.: 922,685

[22] Filed: Jul. 29, 1992

[51] Int. Cl.[6] ..... B21K 1/28

[52] U.S. Cl. ..... 29/894.323; 301/63.1

[58] Field of Search ..... 29/894.32, 894.321, 29/894.322, 894.323, 894.325, 894.362; 301/63.1, 9.2

[56] References Cited

U.S. PATENT DOCUMENTS 2,088,992 8/1937 Bierwirth et al. ..... 29/894.325

2,133,144 10/1938 Johnson ..... 29/894.325

2,975,511 3/1961 Johnson ..... 29/894.325

3,195,491 7/1965 Bulgrin et al. ..... 29/894.325

*Primary Examiner*—P. W. Echols

*Attorney, Agent, or Firm*—Graham & James LLP

[57] ABSTRACT

An automotive wheel and a method for manufacturing, in which a center hub is formed using drawing and stamping methods, is disclosed. A mounting foot is spin forged onto the edge portion of the formed center hub, and the center hub is then polished and mounted into a separately formed cylindrical rim. The resulting automotive wheel has the look of a machined billet-type automotive wheel but with a substantial reduction in wasted material and corresponding cost.

1 Claim, 5 Drawing Sheets

METHOD OF FORMING AN AUTOMOTIVE WHEEL

BACKGROUND OF THE INVENTION

1. Field of the Invention

The present invention relates to vehicle wheels and more particularly, to a method for manufacturing light weight automotive wheels having the appearance and advantages of machined billet-type automotive wheels. Still more particularly, the present invention is directed to an automotive wheel and a method for manufacturing in which the center section is formed by cold drawing and stamping a single aluminum disk to obtain a desired size and cross-sectional profile.

2. Description of the Prior Art

Certain types of two-piece automotive wheels are comprised of a center section mounted within a generally cylindrical rim. The center section further includes a hub having a mounting surface, and is formed using one piece of material such as a steel or aluminum disk. The cylindrical rim is formed using a second piece of material which is compatible with the material comprising the center section. The formed center section is then fixed within the cylindrical rim by, for example, welding, to form the basic wheel. Additional polishing, plating, or other finishing processes are then used to complete the wheel.

As indicated, the center section of the automotive wheel is generally formed using a single piece of material such as aluminum or steel. For example, in a typical prior art method of manufacturing aluminum automotive wheels, a single aluminum disk ("billet") approximately two inches thick and thirteen inches in diameter is machined to form the center section. The machining steps include turning the aluminum billet to obtain the basic center section shape, milling one or more decorative and/or cooling openings in the machined billet, and drilling the holes for the lug bolts. These steps result in substantial material waste which contributes to the finished billet-type automotive wheel being very expensive. Due to their very high cost, billet-type wheels are often used with custom and exotic automobiles.

In another prior art method of manufacturing aluminum automotive wheels, the center section is cast to form the basic shape. The holes for the lug bolts are then drilled and the casting is polished to form the finished center section. Since almost any center section design can be realized by casting, the number of possible wheel designs is much greater with casting than machining. However, while casting provides more freedom of design than machining, cast automotive wheels are not as strong as machined wheels of similar size or weight.

Specifically, since the aluminum used in casting is not pure the microscopic structure of the cast hub is porous, resulting in lower density than a similar sized aluminum billet. In contrast, the aluminum billet is rolled and/or extruded to a given density in order to achieve a desired strength and ductility. Thus, in order to obtain a cast wheel of similar strength as that of a machined wheel, the cast wheel must be of greater mass or have a different shape. Therefore, cast aluminum wheels are typically heavier and bulkier than machined aluminum wheels.

In a prior art method of manufacturing steel automotive wheels, the center section is formed by stamping a steel disk into the desired cross-sectional profile. Since a steel disk of a given thickness is stronger than an aluminum disk of the same thickness, a relatively thin steel disk can be stamped using, for example, a conventional punch press. However, steel automotive wheels are much heavier than aluminum automotive wheels and, further, may be subject to corrosion. In addition, steel automotive wheels are generally considered less stylish than aluminum wheels.

The cross-sectional profile of the center section of aluminum or steel wheels can range from concave (i.e. dish-shaped) to convex (.i.e. crowned). Additionally, the mounting surface of the hub must be offset a specified distance from the inside edge of the rim. Both the cross-sectional profile and the mounting surface offset determine the required thickness of the hub, as measured from the front center surface of the hub to the mounting surface. Thus, in order to obtain a particular profile and offset, machined wheels employ an aluminum billet whose thickness generally corresponds to the required thickness of the hub.

SUMMARY OF THE INVENTION

The present invention is directed to an aluminum automotive wheel and a method of manufacturing, which provides the strength and style of a fully machined billet wheel but with substantially less wasted material and at a resultant lower cost. A center section having a flat or convex cross-sectional profile is formed from a single aluminum disk having a nominal thickness of one half inch. The method of the present invention uses cold drawing and stamping steps which minimize the amount of wasted material, while providing a wheel having the strength, appearance and cross-sectional profile of a more expensive machined wheel.

In accordance with the present invention, the center section is formed by first cold drawing a center portion of the aluminum disk in a direction perpendicular to the plane of the aluminum disk. The drawing step uses a first cylindrical center punch having large radius corners, along with annular clamping blocks also having large radius corners. The first cylindrical punch moves the center portion of the disk blank in the direction perpendicular to the plane, while the annular clamping blocks simultaneously hold an outer portion of the aluminum disk which is clamped in the annular clamping block. The drawing step radially stretches the aluminum disk between the outer edge and the center portion.

The second step is to form the desired cross-sectional profile of the center section using two stamping sub-steps. As mentioned above, the desired cross-sectional profile may range from essentially flat to convex. The first stamping sub-step completes the formation of the hub into a cylindrical "hat" shape in which an axial distance between the mounting surface and the front surface of the hub is approximately two inches. The axial distance corresponds to the hub thickness of a machined wheel, and is necessary to obtain the desired cross-sectional profile and mounting surface offset.

More particularly, the first sub-step forms the hub using a second cylindrical punch having the required size and shape. The hub of the aluminum disk is formed to closely fit the second cylindrical punch. The two important dimensions of the hub are the diameter and the previously discussed axial distance between the mounting surface and the front surface of the hub. The diameter of the hub is determined by the corresponding diameter of the second cylindrical punch, while the axial distance is determined by the amount of material drawn during the first step.

The second stamping sub-step forms the outer portion of the aluminum disk using an annular punch having the desired cross-sectional profile. The outer portion of the aluminum disk is formed to closely fit the annular punch.

Once the cross-sectional profile of the center section has been obtained, the outer edge of the center section is spin forged to form a thickened circumference which provides a suitable mounting surface for the cylindrical rim. One or more cooling and/or decorative openings may be machined into the outer portion of the center section, and one or more lug mounting holes are drilled in the mounting surface of the hub. Both of these steps use conventional methods. The cylindrical rim is separately formed by a roll pressing operation and is polished, again using conventional methods. The center section is then polished and positioned within the rim and welded in place.

DETAILED DESCRIPTION OF THE PREFERRED EMBODIMENT

The following description is of the best presently contemplated mode of carrying out the present invention. This description is made for the purpose of illustrating the general principles of the invention and should not be taken in a limiting sense. The scope of the present invention is best determined by reference to the appended claims.

Figure 2:
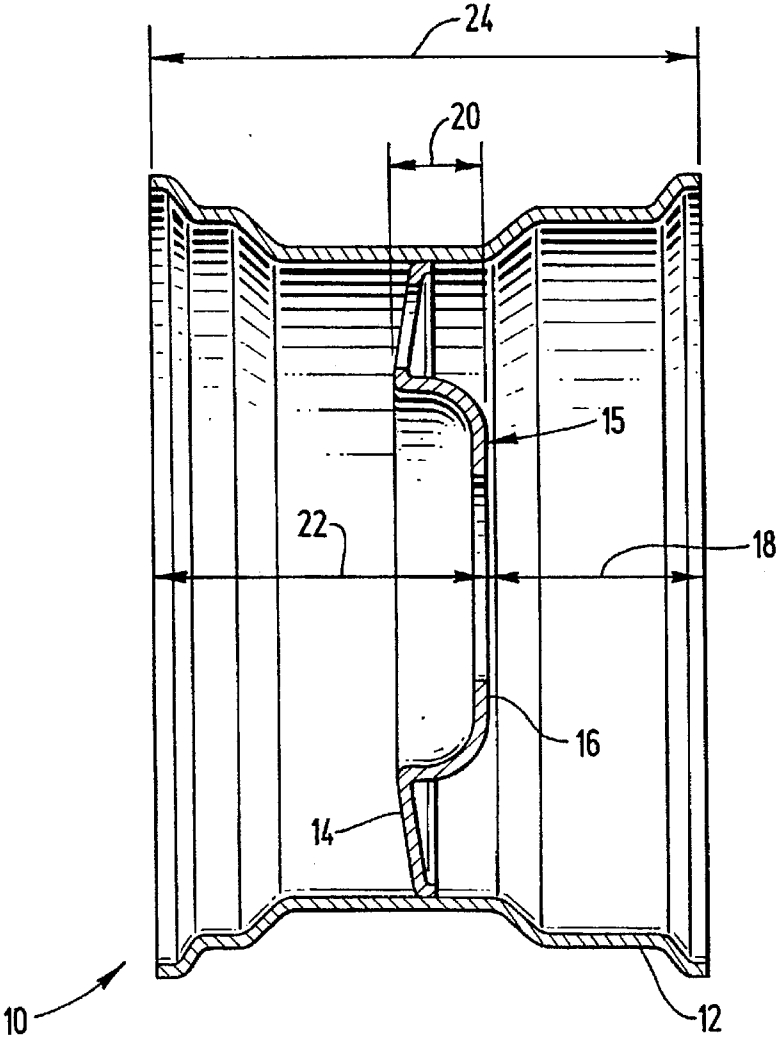
FIG. 2 is a sectional view of the exemplary automotive wheel of FIG. 1.
Figure 1:
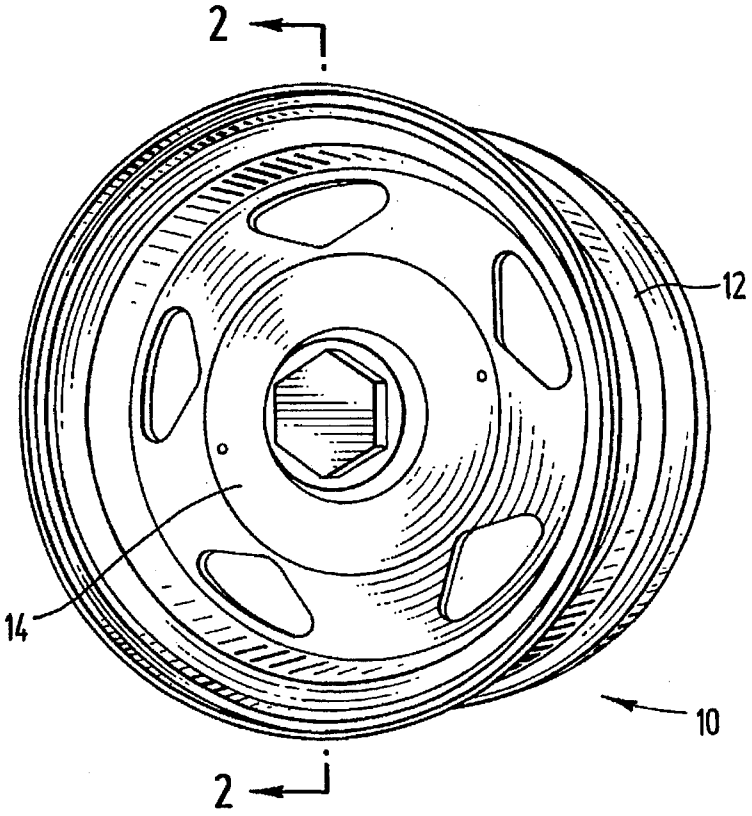
FIG. 1 is a perspective view of an exemplary automotive wheel manufacturing in accordance with the present invention.
Figure 3A:
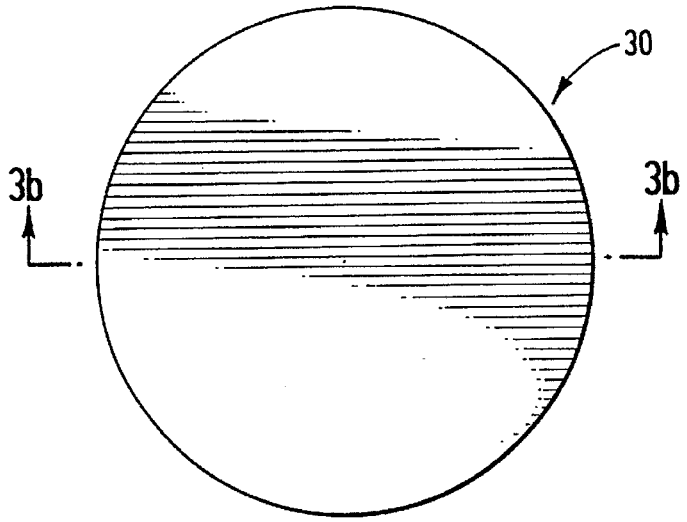
FIG. 3a PRIOR ART
FIGS. 3(*a*)–3(*d*) are sectional views illustrating the steps of a prior art method of forming automotive wheels.
Figure 3B:
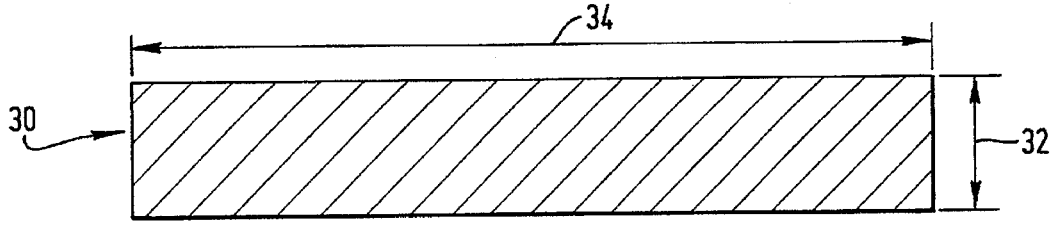
FIG. 3b PRIOR ART
Figure 3C:
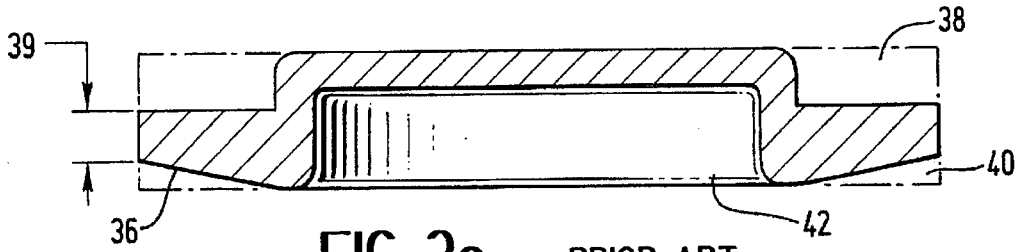
FIG. 3c PRIOR ART
Figure 3D:
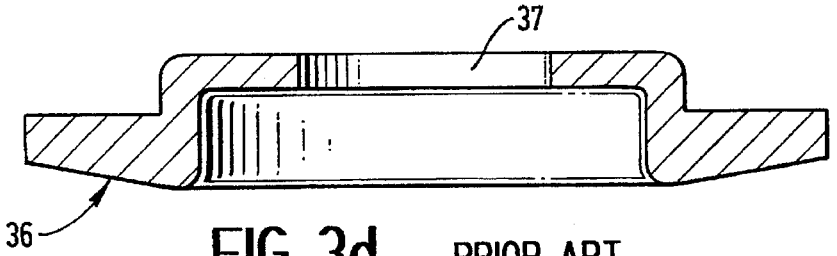
FIG. 3d PRIOR ART

A perspective view of a typical two-piece automotive wheel 10 constructed using the principles of the present invention is shown in FIG. 1. The wheel 10 includes a cylindrical rim 12 and a center section 14. For structural and aesthetic reasons, the cylindrical rim 12 and the center section 14 typically have a contoured cross-sectional profile as shown in FIG. 2. In the preferred embodiment, the center section 14 is formed from a single aluminum disk and includes a hub 15 having a mounting surface 16. The cylindrical rim 12 is formed from a second portion of aluminum by roll pressing or spin forging. The center section 14 and the cylindrical rim 12 are then polished and welded together to form the finished wheel 10.

The important dimensions of the wheel 10 are also shown in FIG. 2. A mounting surface offset 18 is the distance between the mounting surface 16 and the rear edge of the rim 12. Similarly, a front spacing distance 22 is the distance between the mounting surface 16 and the front edge of the rim 12. Additionally, an axial distance 20 is the distance between the mounting surface 16 and the front surface of the hub 15 at a point radially adjacent to the mounting surface 16. For wheels having flat or convex cross-sectional profiles, the axial distance 20 is the most important dimension and nominally measures two inches.

FIGS. 3(*a*)–3(*d*) illustrate a prior art method of manufacturing a center section 36 of a machined aluminum wheel, and are provided for comparison with the method of the present invention. Starting with an aluminum billet 30 of thickness 32 and diameter 34, the center section 36 having a convex cross-sectional profile is machined. The specific values of the thickness 32 and the diameter 34 are determined by the desired cross-sectional profile of the wheel being manufactured, along with the required mounting surface offset 18 and axial distance 20. Typical minimum values are two inches for the thickness 32 and thirteen inches for the diameter 34, which provides sufficient material to machine the center section 36 with the required axial distance 20.

The aluminum billet 30 is turned on a lathe or similar machine tool to form the desired crowned cross-sectional profile of the center section 36. A minimum thickness 39 of one half to three fourths of an inch must be maintained during machining in order to provide the necessary strength at the contact point between the center section 36 and a cylindrical rim. The machining of the aluminum billet 30 to form the center section 36 results in substantial portions 38–40 of the aluminum billet 30 being cut away as scrap.

Once the center section 36 has been machined from the aluminum billet 30, a center hole 37 and one or more lug bolt holes (not shown) are drilled into the mounting surface of the center section 36. Additionally, one or more cooling and/or decorative openings (not shown) may be machined into the outer portion of the center section 36. The center section 36 is then polished and welded to a cylindrical rim at the rear surface to complete the machined aluminum wheel. A small hub cap (not shown) is employed to cover the lug nuts after mounting the wheel.

Figure 4A:
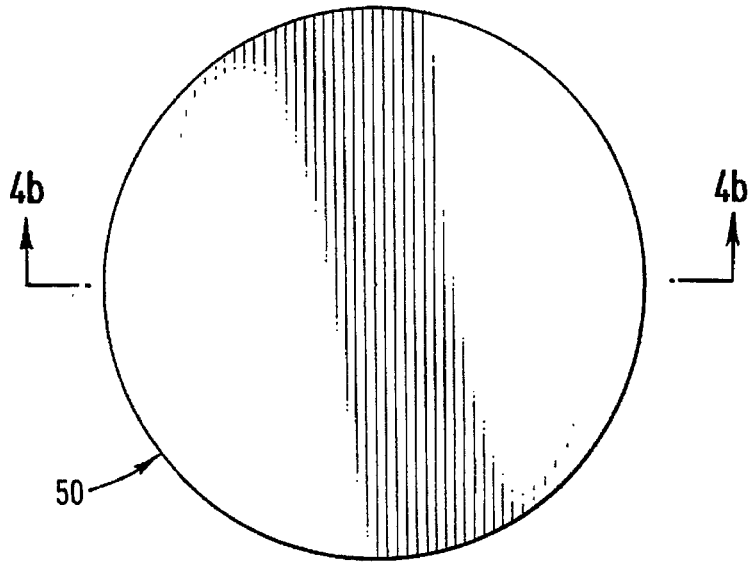
FIGS. 4(*a*)–4(*b*) show an exemplary aluminum disk used to form the center section of an automotive wheel by the method of the present invention.
Figure 4B:
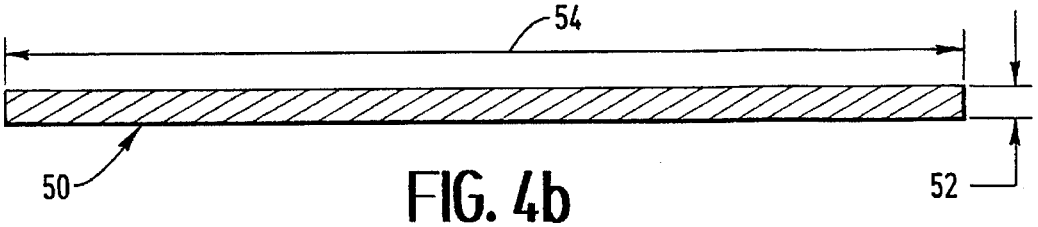

Referring now to FIGS. 4–8, a preferred method of forming the center section 14 of the aluminum automotive wheel 10 (FIG. 2) is discussed. As shown in FIGS. 4(*a*)–4(*b*), a 6061-T6 aluminum disk 50 having a nominal thickness 32 of one half inch and a diameter 54 which is somewhat greater than the final diameter of the center section 14 provides the starting material for the center section 14. The aluminum disk 50 includes a center portion 64, an edge portion 66, and an outer portion 68, the latter having a front surface and a rear surface.

Figure 5:
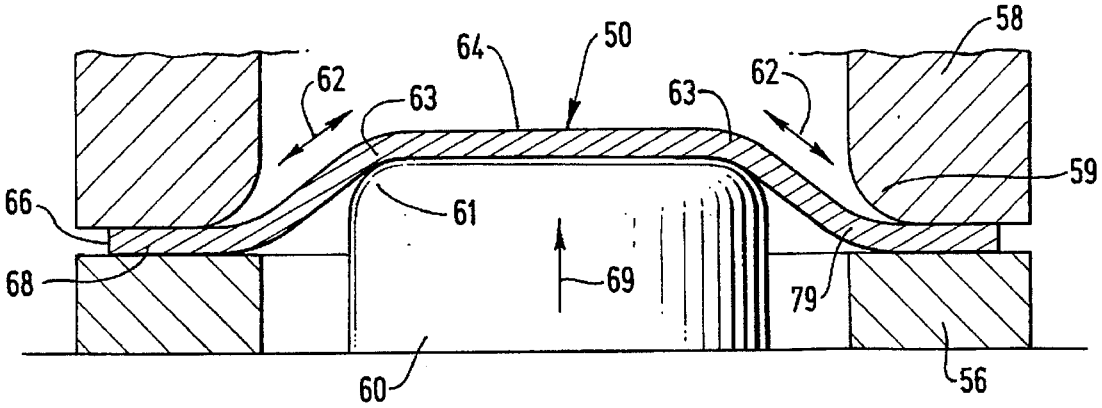
FIG. 5 is a sectional view illustrating the drawing step of the present invention.

Referring to FIG. 5, the center portion 64 of the aluminum disk 50 is drawn perpendicular to the common plane, while the outer portion 68 of the aluminum disk 50 is held fixed. More particularly, the drawing step uses a first cylindrical punch 60 having large radius corners 61, along with annular clamping blocks 56 and 58, the latter also having large radius corners 59, so that the aluminum disk 50 is stretched in directions 62. The center portion 64 is drawn in direction 69 until the distance between the rear surface of the center portion 64 and the front surface of the outer portion 68 is approximately two inches. The radial stretching maintains a nominal thickness of one half inch at the bend points 63 and 79.

Figure 6:
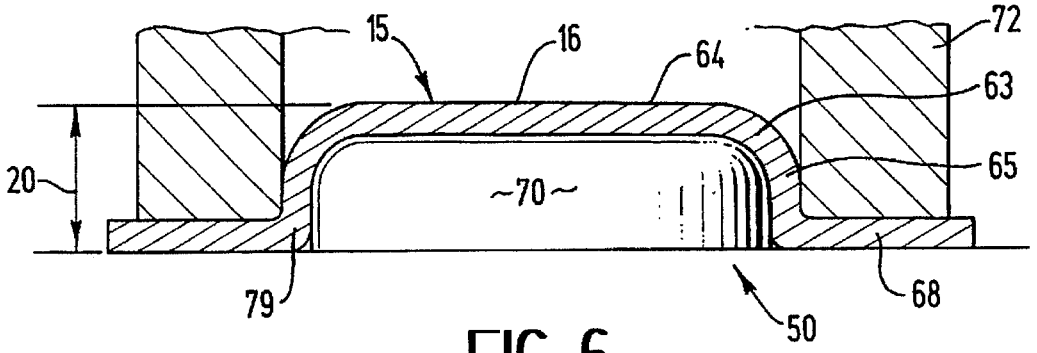
FIG. 6 is a sectional view illustrating the first stamping sub-step of the present invention.

Continuing with FIG. 6, the center portion 64 and the cylindrical side wall 65 of the aluminum disk 50 are then formed into the hub 15 using a first stamping sub-step. More particularly, the first stamping sub-step forms the center portion 64 and the cylindrical side wall 65 into the hub 15 using a second cylindrical punch 70 of the required size and shape. The center portion 64 becomes the mounting surface 16 and the cylindrical side wall 65 extends axially rearward from the rear surface of the outer portion 68. Conversely, the outer portion 68 extends radially outward from the bend points 79 located at one end of the cylindrical side wall 65. Additionally, the mounting surface 16 extends radially inward from, and is oriented substantially perpendicular to, the bend points 63 at the other end of the cylindrical side wall 65.

Using the above-described structure, the cylindrical side wall 65 outer wall provides the axial distance 20 from the mounting surface 16 to the front surface of the outer portion 68 at a point radially adjacent to the mounting surface 16. More importantly, as a result of the cold drawing step the material thickness at the bend points 63 and 79 is nominally maintained at one half inch.

Figure 7:
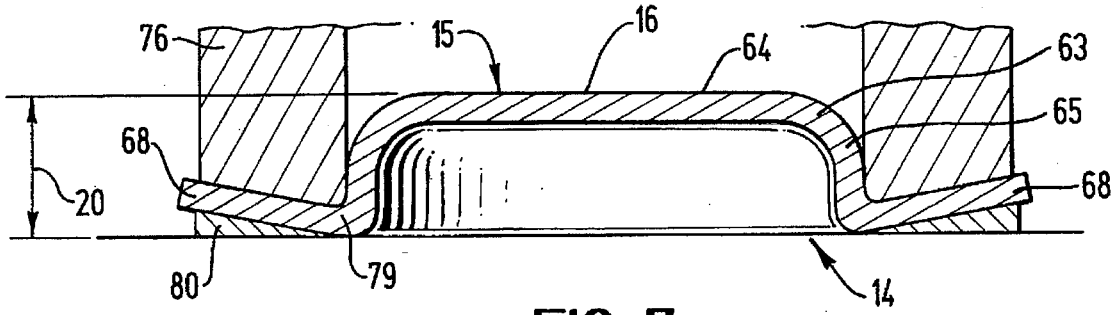
FIG. 7 is a sectional view illustrating the second stamping sub-step of the present invention.

Referring now to FIG. 7, a second stamping sub-step is then performed to form the outer portion 68 into the desired convex (e.g. crown) cross-sectional profile. Specifically, the second stamping sub-step forms the outer portion 68 of the aluminum disk 50 using an annular form or mold having the desired cross-sectional profile of the finished center section 14. As mentioned above, the first and second stamping sub-steps result in the center portion 64 becoming the mounting surface 16, while the cylindrical side wall 65 provides the required axial distance 20 between the mounting surface 16 and the front surface of the outer portion 68.

Figure 8:
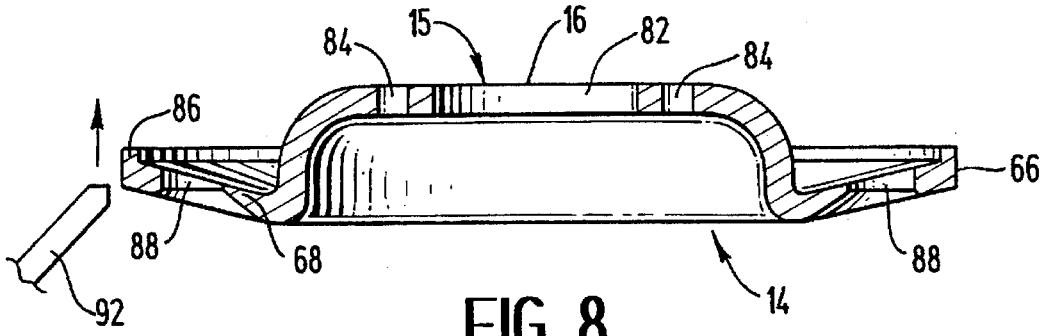
FIG. 8 is a sectional view of the finished center section of an automotive wheel manufactured by the method of the present invention.

Continuing with FIG. 8, once the convex cross-sectional profile of the center section 14 has been formed, a mounting foot 86 is spin forged onto the outer edge 66 of the center section 14 to provide a mounting surface for the rim 12 of sufficient strength to pass appropriate tests. This spin forging step widens the outer edge 66 and results in a mounting foot 86 having a width of approximately three fourths of an inch, thus providing sufficient surface area for mounting the center section 14 to the rim 12. The widened mounting foot 86 is important since it provides the necessary strength at the contact point between the center section 14 and the rim 12, without requiring that the remainder of the center section 14 have the same thickness. Additionally, a center hole 82 and one or more lug mounting holes 84 are drilled into the mounting surface 16 of the hub 15 as shown. Further, one or more cooling and/or decorative openings 88 may be machined into the outer portion 68 of the center section 14.

Figure 9:
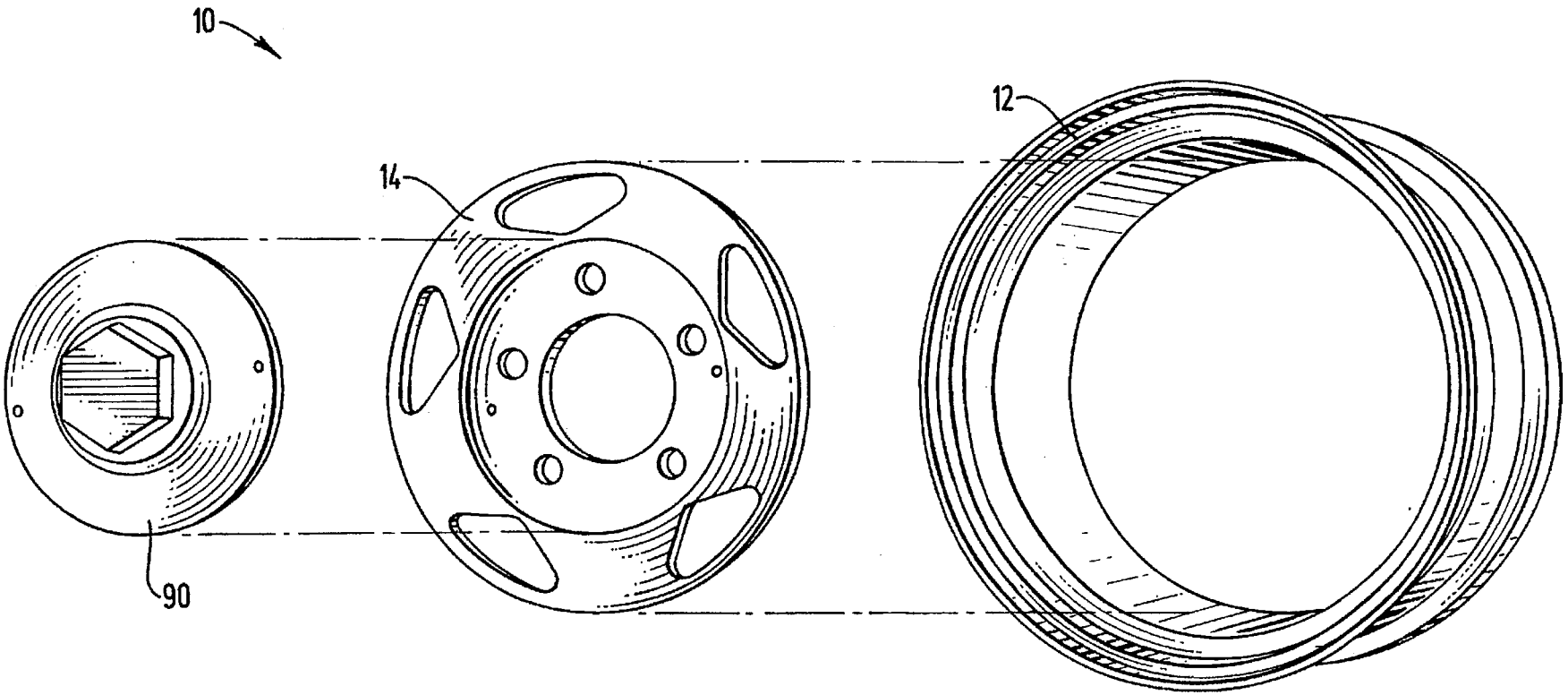
FIG. 9 is a perspective view showing the assembly of the automotive wheel of FIG. 1.

Referring to FIG. 9, the center section 14 is then polished and welded into the rim 12. A decorative cap 90 is machined or stamped from another aluminum disk, polished, and attached to the center section 14 using, for example, machine screws. The result of the above steps is an aluminum wheel 10 which has the look and strength of a machined billet-type automotive wheel, but without the associated material waste and corresponding cost. The aluminum wheel 10 of the present invention is lighter and stronger than a comparable cast wheel of similar design. The resulting wheel 10 is stylish and may be priced to be available to a larger portion of the automotive market.

While the preferred embodiment of the present invention has been described, it should be noted that a number of changes and improvements can be made to the method without departing from the spirit and scope of the invention. Accordingly, the invention is not to be limited by the specific illustrated embodiment but only by the scope of the appended claims.

What is claimed is:

1. A method for forming an automotive wheel, said automotive wheel comprising a rim and a center section including a hub, said method comprising the steps of:

providing a generally circular metallic disk, said disk including a center portion and an edge portion;

forming said hub from said center portion of said disk;

spin forging said edge portion of said disk to form a widened edge for mounting said center section to said cylindrical rim; and mounting said center section within said rim to form said automotive wheel.

* * * * *